US006227683B1

(12) United States Patent
Tukia

(10) Patent No.: US 6,227,683 B1
(45) Date of Patent: May 8, 2001

(54) FLAG-POLE LIGHT

(76) Inventor: Aki Tukia, Tarttilantie 6 A 3
FIN-03400, Vihiti (FI)

( * ) Notice: Subject to any disclaimer, the term of this patent is extended or adjusted under 35 U.S.C. 154(b) by 0 days.

(21) Appl. No.: 09/171,811

(22) PCT Filed: Apr. 29, 1997

(86) PCT No.: PCT/FI97/00261

§ 371 Date: Oct. 27, 1998

§ 102(e) Date: Oct. 27, 1998

(87) PCT Pub. No.: WO97/42449

PCT Pub. Date: Nov. 13, 1997

(30) Foreign Application Priority Data

May 3, 1996 (FI) ..... 961906

(51) Int. Cl.[7] ..... F21V 7/00; F21V 5/00

(52) U.S. Cl. ..... 362/303; 362/298; 362/300; 362/307; 362/329

(58) Field of Search ..... 362/414, 351, 362/431, 360, 329, 298, 300, 303, 307

(56) References Cited

U.S. PATENT DOCUMENTS

| | | | |
|---|---|---|---|
| 1,171,917 | 2/1916 | Axford . | |
| 1,660,341 | 2/1928 | Lafworth . | |
| 1,740,747 | 12/1929 | Price . | |
| 3,476,929 | 11/1969 | Klinger . | |
| 3,752,975 | 8/1973 | Meyer . | |
| 3,895,348 | 7/1975 | Palermo . | |
| 4,974,137 * | 11/1990 | Evans, Jr. et al. | 362/300 |
| 5,343,825 | 9/1994 | Gazecimeon et al. . | |

FOREIGN PATENT DOCUMENTS

| | | |
|---|---|---|
| 1-3918169 | 11/1990 | (DE) . |
| 881266 | 2/1991 | (FI) . |
| 8800900-6 | 9/1989 | (SE) . |
| 8701755 | 3/1987 | (WO) . |

* cited by examiner

*Primary Examiner*—Audrey Chang
*Assistant Examiner*—Jennifer Winstedt
(74) *Attorney, Agent, or Firm*—Birch, Stewart, Kolasch & Birch, LLP

(57) ABSTRACT

The invention relates to a flag-pole light provided by means of a luminous knob comprising a light source which is provided within a cover and emits light rays that are reflected from reflecting surfaces through a translucent lower portion of the cover. The luminous knob of the invention can be mounted on existing flag-poles in place of a conventional knob or on new poles during their manufacture.

18 Claims, 1 Drawing Sheet

FLAG-POLE LIGHT

This application is the national phase under 35 U.S.C. §371 of prior PCT International Application No. PCT/FI97/00261 which has an International filing date of Apr. 29, 1997 which designated the United States of America, the entire contents of which are hereby incorporated by reference.

BACKGROUND OF THE INVENTION

1. Field of the Invention

The present invention relates to a flag-pole light provided in a simple manner by means of a luminous flag-pole knob preferably of a conventional design.

2. Background Art

Various flags, such as national, advertising and organizational flags, and pennants flying on flag-poles are generally poorly or not at all visible in the dark. It is however often desired that flags and pennants be visible at any time of the day or night and at any time of the year, and therefore floodlights have sometimes been used to improve their visibility. Depending on the voltage range used, floodlight installations are, however, subject to licensing. In addition, floodlights are often difficult to use, and the investment and operating costs of the necessary equipment may be very high.

Various solutions relating to flag-pole lights have been disclosed in the prior art. Finnish Patent Application No. 881,266 discloses a transparent tube which contains lighting equipment and which is to be mounted at the top of a flag-pole. This solution involves mounting a separate element as an extension or part of a flag-pole.

German Offenlegungsschrift No. 39 18169 discloses a separate rotating light to be mounted at the top of a flag-pole by fixing it to a rotating outer tube of the flag-pole, to which the flag is also attached. The flag, the outer tube and the light thus rotate with the wind. Even this solution requires that separate equipment be installed in the flag-pole.

U.S. Pat. No. 3,752,975 discloses a solution for illuminating a flag flying on a flag-pole. The flag-pole is surmounted by a lamp unit comprising an upwardly tapered canopy which comprises a shade supported upon legs. The upper end of the shade is provided with a lamp socket to which a downwardly extending spot light lamp is attached. Electrical wires extend along the legs and further along the pole to a timer. This solution, too, is complicated with its legs and separate shade.

In addition to the solutions described above, there have been attempts to illuminate a flag-pole by means of other separate lighting systems mounted on the flag-pole or at its top. All of these solutions are difficult to implement, they are not easily applicable to existing flag-poles, and it is not profitable to manufacture them in series.

SUMMARY OF THE INVENTION

An object of the present invention is to provide illumination of a flag-pole by an easy and simple solution without any additional parts not contained in a normal flag-pole. A further object of the invention is to provide a flag-pole light which can be installed and used without difficulty in both existing poles and in new poles manufactured in series. Yet another object of the invention is to provide a light which is applicable to flag-poles in both the vertical and diagonal positions.

The present invention is based on the idea of providing a light at the top of both new and existing flag-poles in a simple, inexpensive and easy manner for illuminating particularly flags and pennants by replacing a normal non-luminous flag-pole knob with a luminous knob of the invention. A flag-pole is thus illuminated with a luminous flag-pole knob of the invention, which is characterized by the claims disclosed herein. The solution of the present invention for illuminating flag-poles has not been disclosed previously.

Flag-poles that are manufactured industrially are hollow, and they can be tilted by means of a pivoted joint situated at a lower portion of the pole. In addition, they comprise a separate knob portion which is secured to the pole by means of a fitting. Currently, most conventional knob portions are made from a translucent resistent plastic which is usually painted white or silver. Knobs made of aluminum were also used previously, but because of the high costs, their manufacture has almost completely stopped. The solution of the present invention utilizes these features of a flag-pole efficiently and in a new manner for providing illumination at the top of a flag-pole.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the luminous flag-pole knob will be described in greater detail with reference to the accompanying drawing which are given by way of illustration only, and thus are not limitative of the present invention, and wherein.

DETAILED DESCRIPTION OF THE INVENTION

Figure 1:
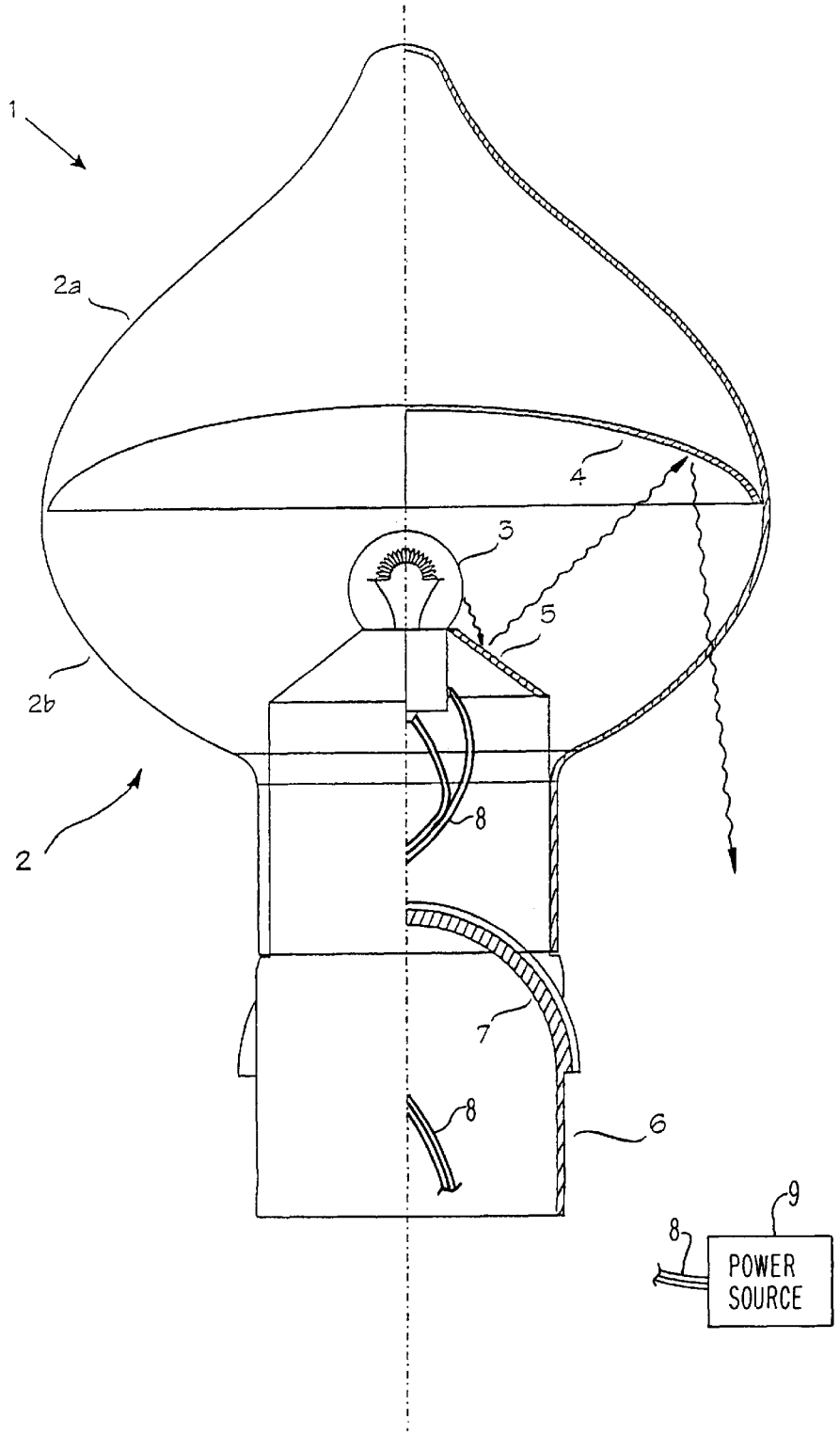
FIG. 1 shows a view/cross-section of a luminous flag-pole knob.

According to the present invention, illumination of flags and pennants flying on a flag-pole is provided by replacing a conventional nonluminous flag-pole knob with a luminous knob of the invention. FIG. 1 shows a luminous knob 1 of the invention, comprising a knob cover 2 with an upper portion 2*a* and a lower portion 2*b*, a light source 3, a reflecting surface 4 and optionally a reflecting surface 5, and a fitting 6 which is attached to the knob cover and usually comprises a guide 7 for flag ropes. The luminous knob further comprises electrical wires 8 extending from the light source through the hollow inner portion of the pole to a power source 9.

The knob may be of any existing design, e.g. a sphere, flattened sphere or bulb. The conventional non-luminous knobs are made from a translucent plastic which is coated so as to be opaque, for example by painting them throughout either white or silver. Such a knob is used as the luminous knob of the invention; however, only the top portion 2*a* of the knob is coated for instance by painting, whereas the lower portion 2*b* remains uncoated and translucent.

Conventional low voltage lamps are suitable for use as the light source 3 in the knob. Low voltage refers to a voltage range of about 6 to 24 V, which is sometimes also called the safety voltage range. The lamps used in the luminous flag-pole knob of the invention are of about 10 to 70 W, depending on the desired luminous intensity. When a suitable voltage is selected, it should be noted that the life of the lamp increases when a lower voltage is used. The power source used for the light source is either a battery or line current supplied through a transformer. Low voltage installations are not subject to any specific licensing, but can be performed by anyone as long as the installation instructions are followed. Devices operating in the low voltage range are, moreover, safe and consume little electricity.

Essential parts of the luminous knob 1 of the invention are the reflective surfaces 4 and 5 provided within the cover, reflective surface 5 being optional. Reflective surface 4 is mounted in a desired position above the light source 3 inside the cover. The direction of the light rays emitted from the light source 3 and reflected from the reflective surface 4 is selected by adjusting the position of the reflecting surface. In the case of vertical flag-poles secured to the ground or to a roof, the reflective surface 4 is preferably mounted in a horizontal position, whereby a flag flying on the pole is illuminated impressively. In the case of flag-poles secured diagonally to a wall, for example, the reflective surface 4 inside the cover 2 is preferably mounted diagonally in relation to the horizontal axis of the cover in order to illuminate a flag or pennant flying on the pole. The reflective surface 4 is preferably slightly concave, whereby light rays are reflected more efficiently on account of multiple reflections. The size of the reflective surface 4 is such that it can be tightly fitted to the inner surface of the cover 2 to ensure that it remains firmly in place. Since the cover is made from two portions in such a way that there is a joint in the middle of the cover, the reflective surface 4 can be mounted simply by pushing it into the cover or by pressing it in its place during the manufacture of the cover. If necessary, it is possible to use glue or other fixing means to ensure the fixing. To enhance the illuminating effect, it is possible to provide a reflective surface 5 within the cover preferably as a collar or sleeve around the light source 3, whereby the reflection area of the light is further expanded. The reflecting surfaces 4 and 5 are made from materials that are conventionally used in reflecting surfaces and that can be easily machined, e.g. plastic coated with a reflective material, steel plate, or aluminum. According o one embodiment of the invention, the reflective surface is formed by the upper portion 2*a* of the cover painted with reflective paint. However, more efficient reflection and thus a better lighting effect is achieved with separate reflecting surfaces 4, 5 provided within the cover 2. The lower portion of the luminous knob is also provided with a fitting 6 for securing the actual knob portion to the pole. It is also possible to add further fittings to the fitting 6, if necessary in view of the pole measures.

Further embodiments of the luminous flag-pole knob of the invention are knobs emitting colored light. Such embodiments are particularly suitable for illuminating advertising flags or pennants, for example. The color effect is provided simply by using colored lamps or a colored, but translucent lower portion of the cover. In addition to flag-poles, the luminous knobs of the invention can also be used as outdoor lights, if they are mounted at the ends of hollow tubes or poles using any necessary fittings, as described above in connection with flag-poles.

The luminous flag-pole knob of the invention is particularly well suited for industrial serial production, if its measures are designed so that it can be used as such in place of a conventional non-luminous knob. The knob of the invention can be mounted either on a new flag-pole during the manufacture of the pole or on an existing flag-pole in place of an old non-luminous knob.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A light for a flag pole with a flag comprising:

a light source for electrical connection to a power source;

a cover surrounding said light source, said cover having an opaque upper portion and a translucent lower portion;

at least one reflecting surface disposed within said cover, said at least one reflecting surface reflecting light from said light source; and a fitting attached to said cover, said fitting being attachable to an end of the flag pole, wherein light from said light source is directed through said translucent lower portion of said cover in directions generally passing by said fitting and toward the flag, wherein said at least one reflecting surface includes two reflecting surfaces, one of said two reflecting surfaces being disposed above said light source and another of said two reflecting surfaces being disposed below said light source.

2. The light according to claim 1, wherein said two reflecting surfaces are made from a machineable reflecting material.

3. The light according to claim 2, wherein said machineable reflecting material comprises aluminum, steel plate, or plastic coated with reflective material.

4. The light according to claim 1, wherein said one of said two reflecting surfaces is straight or concave and fitted tightly to an inner surface of said cover above said light source.

5. The light according to claim 1, wherein said cover is made from a translucent plastic, and an upper portion of said cover is coated so as to be opaque.

6. The light according to claim 1, wherein said one of said two reflecting surfaces is straight or concave and fitted tightly to an inner surface of said cover above said light source, and said other of said two reflecting surfaces is mounted below said light source as a collar or sleeve.

7. The light according to claim 1, wherein said cover comprises a shape of a sphere, a flattened sphere or a bulb.

8. The light according to claim 1, wherein light from said light source is reflected off said one of said two reflecting surfaces in a generally downward direction toward said fitting.

9. The light according to claim 1, wherein light from said light source is reflected off said another of said two reflecting surfaces in a generally upward direction toward said one of said two reflecting surfaces.

10. The light according to claim 9, wherein light reflected off said another of said two reflecting surfaces is reflected off said one of said two reflecting surfaces in a generally downward direction toward said fitting.

11. The light according to claim 1, wherein said fitting is integrally formed with said lower translucent portion of said cover.

12. The light according to claim 1, wherein said light source operates in a voltage range of about 6 to 24 V, and in a power range of about 10 to 70 W.

13. A combination comprising:

a flag pole with a flag attached thereto;

a light source;

a power source electrically connected to said light source;

a cover surrounding said light source, said cover having an opaque upper portion and a translucent lower portion;

at least one reflecting surface disposed within said cover, said at least one reflecting surface reflecting light from said light source; and a fitting attached to said cover, said fitting being attached to an end of said flag pole, wherein light from said light source is directed through said translucent lower portion of said cover in directions generally passing by said fitting, wherein said at least one reflecting surface includes two reflecting surfaces, one of said two reflecting surfaces being disposed above said light source and another of said two reflecting surfaces being disposed below said light source.

14. The combination according to claim 13, wherein light from said light source is reflected off said one of said two reflecting surfaces in a generally downward direction toward said fitting.

15. The combination according to claim 13, wherein light from said light source is reflected off said another of said two reflecting surfaces in a generally upward direction toward said one of said two reflecting surfaces.

16. The combination according to claim 15, wherein light reflected off said another of said two reflecting surfaces is reflected off said one of said two reflecting surfaces in a generally downward direction toward said fitting.

17. The combination according to claim 13, wherein said light source operates in a voltage range of about 6 to 24 V, and in a power range of about 10 to 70 W.

18. The combination according to claim 13, wherein said cover is made from a translucent plastic, and an upper portion of said cover is coated so as to be opaque.

* * * * *